United States Patent [19]

Andersson

[11] Patent Number: 4,966,227

[45] Date of Patent: Oct. 30, 1990

[54] PLATE EVAPORATOR

[75] Inventor: Jarl Andersson, Lund, Sweden

[73] Assignee: Alfa-Laval Thermal AB, Lund, Sweden

[21] Appl. No.: 438,434

[22] PCT Filed: May 12, 1989

[86] PCT No.: PCT/SE89/00263

§ 371 Date: Dec. 6, 1989

§ 102(e) Date: Dec. 6, 1989

[87] PCT Pub. No.: WO89/11627

PCT Pub. Date: Nov. 30, 1989

[30] Foreign Application Priority Data

May 25, 1988 [SE] Sweden ..... 8801946
May 26, 1988 [SE] Sweden ..... 8801961

[51] Int. Cl.[5] ..... F28F 3/10; F28F 3/08
[52] U.S. Cl. ..... 165/167; 165/166
[58] Field of Search ..... 165/166, 167

[56] References Cited

U.S. PATENT DOCUMENTS 3,042,382 7/1962 Hoyniszak ..... 165/167
3,850,234 11/1974 Fowler ..... 165/153
4,184,542 1/1980 Sumitomo ..... 165/166
4,291,754 9/1981 Morse et al. ..... 165/165
4,296,803 10/1981 Sumitomo ..... 165/110
4,373,579 2/1983 Jernqvist ..... 165/167

FOREIGN PATENT DOCUMENTS 53-43082 4/1978 Japan ..... 165/167

*Primary Examiner*—Martin P. Schwadron
*Assistant Examiner*—Allen J. Flanigan
*Attorney, Agent, or Firm*—Davis Hoxie Faithfull and Hapgood

[57] ABSTRACT

In a plate heat exchanger for evaporation of a liquid conventional heat exchange plates (3) are used which have an elongated and substantially rectangular form and which have corner portions provided with ports. One corner portion of at least every second heat exchange plate has been removed, and outlet openings (16) from the plate interspaces, in which liquid is to be evaporated, has been created by omitting edge gaskets between the heat exchange plates forming these interspaces in the areas of the removed corner portions.

6 Claims, 5 Drawing Sheets

PLATE EVAPORATOR

The present invention relates to a plate heat exchanger comprising a package of heat exchange plates, each of which is elongated and substantially rectangular and has a central heat exchange portion and corner portions provided with ports; an inlet member connected both to a source for liquid to be at least partly evaporated in the plate heat exchanger, and to a first channel through the package of heat exchange plates, which is formed by aligned ports in the heat exchange plates, in- and outlet members connected both to a source and a reception place, respectively, for a heating medium and to two other channels through the package of heat exchange plates, which channels are formed by aligned ports in the heat exchange plates on each side of the central heat exchange portions of the heat exchange plates, said first channel communicating with only every second interspace between the heat exchange plates, while the other two channels communicate with the other interspaces between the heat exchange plates; and sealing means arranged between adjacent heat exchange plates such that said liquid and the heating medium during operation of the plate heat exchanger are allowed to flow substantially in parallel through the plate interspaces in the longitudinal direction of the heat exchange plates, either concurrently or countercurrently.

Plate heat exchangers of the above described general kind are known and used since at least 50 years. They are used for many different heat exchange duties, such as for evaporation of liquids.

In connection with evaporation of a liquid there is a problem in that the steam released from the liquid has a volume that is many times larger than the volume of the liquid out of which the steam has been formed. This means that those ports of the heat exchange plates which are to form an outlet channel through the plate package for the formed steam and possibly remaining liquid have to be made very large in order that the outlet channel should not create a too large through-flow resistance for the steam. Such a particular shape of the heat exchange plates, and a necessary adaptation thereto of other parts of the plate heat exchanger, makes the production of the whole plate heat exchanger expensive.

In U.S. Pat. No. 3,201,332 (corresponding to SE 200.605) a solution to the above discussed problem was suggested. The solution resided in use of conventional heat exchange plates with relatively small ports in all of the four corners, an outlet opening for the formed steam and possibly remaining liquid being created by omission of the sealing means in every second plate interspace along the upper part thereof. An advantage of this solution was that already available heat exchange plates produced for other heat exchange duties could be used also in connection with evaporation of liquids.

In U.S. Pat. No. 3,201,332 there is described in detail only one embodiment of the suggested plate heat exchanger, in which the long sides of the plates extend horizontally. The reason therefore is that the outlet openings from the plate interspaces for the at least partly evaporated liquid, which openings are situated at the top, should be made as large as possible to offer as small a flow resistance as possible. Possibly, the inventor in question has noticed that the flow resistance in the outlet openings would have become undesirably large, if the heat exchange plates had been arranged with their long sides extending vertically and, thus, the outlet opening from every second plate interspace had been created by omission of the sealing means only along the upper short sides of the heat exchange plates.

However, by arranging the heat exchange plates with their long sides extending horizontally and by having the outlet openings for the at least partly evaporated liquid extending along the upper whole long sides of the plates the inventor has changed the heat exchange conditions, for which the heat exchange plates in question were originally calculated. Thus, the flow conditions concerning for instance the pressure drop in the plate interspaces for the treated liquid have been changed. Further, it has been made impossible in practice to accomplish an even flow distribution of liquid in the plate interspaces, and for this reason part of the liquid is forced to flow a substantially longer distance than another part of the liquid between the inlet and the outlet of each plate interspace.

The main object of the present invention is to provide a plate heat exchanger of the initially defined kind, which offers a very small pressure drop in the outlet for steam and possibly remaining liquid and in which said liquid and steam are allowed to flow in the longitudinal direction of the heat exchange plates substantially evenly distributed across the width of the heat exchange plates.

A further object of the invention is to provide a plate heat exchanger which can be produced by means of heat exchange plates having ports in all of their corner portions.

This object can be achieved in a plate heat exchanger of the initially defined kind, which is characterized in that at least every second one of the heat exchange plates is without a corner portion, in which a port of the same kind as anyone of the other ports could have been situated, and in that said sealing means leaves outlet openings from the plate interspaces, which communicate with said first channel, in those areas of the heat exchange plates where at least every second one thereof is without a corner portion. Preferably all of the heat exchange plates are without one of their corner portions.

By this invention it is possible to obtain the technical effect that was strived at by the suggestion according to the above-mentioned U.S. Pat. No. 3,201,322 but that could not be obtained without orientation of the heat exchange plates with their long sides extending horizontally, meaning that the heat exchange plates could no longer be utilized to the whole of their thermal capacity.

Thanks to the invention the thermal capacity of the heat exchange plates can be used to its maximum. Furthermore, by the fact that the outlet for the formed steam and possibly remaining liquid has got a substantially reduced through-flow resistance, compared to that obtainable in a convention outlet channel extending through the plate package, a larger part of the pressure drop offered by the whole plate heat exchanger may be used for effective heat exchange. Alternatively, the invention may be taken advantage of in a way such that the total pressure drop used for the whole heat exchanging operation is reduced.

If in a plate heat exchanger according to U.S. Pat. No. 3,201,332 an outlet for said liquid and steam would be created only by omission of the shown gaskets along the upper short sides of the heat exchange plates, this outlet possibly had offered a smaller through-flow resistance than a conventional channel through the plate package, formed by ports in the heat exchange plates, but a substantially larger flow resistance than the outlet in a plate heat exchanger according to the invention. This depends on the fact that the liquid and steam flowing out through such an outlet according to U.S. Pat. No. 3,201,322 would have to pass through several constrictions formed by the corner portions of the heat exchange plates, not only the constrictions formed by the gasket grooves in these corner portions, from where gaskets have been removed, but also constrictions formed as a consequence of the fact that several contact places are arranged between the adjacent plates in these corner portions.

A heat exchanger according to the the invention may be oriented in any desired way. It is preferred, however, that the heat exchange plates are arranged with their long sides extending substantially vertically, the outlet openings for the formed steam and possibly remaining liquid being directed upwardly.

The invention is described below with reference to the accompanying drawing. In the drawing FIG. 1 shows a plate heat exchanger according to the invention.

Figure 1:
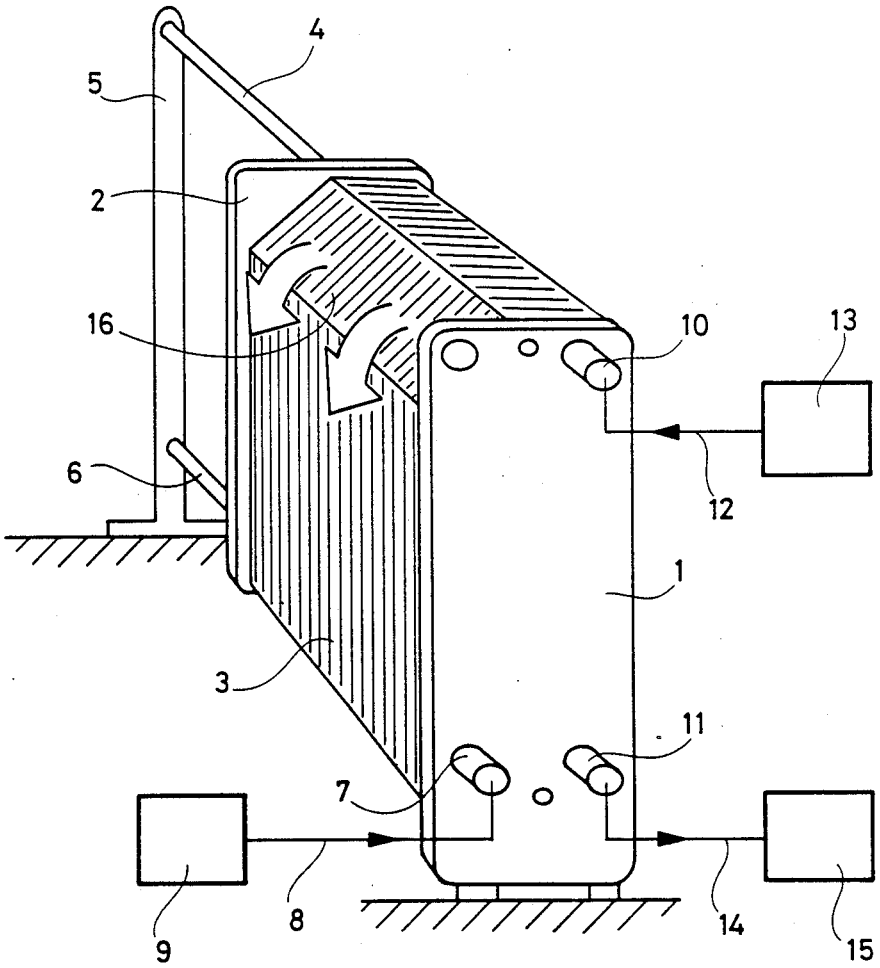

FIG. 1 shows a plate heat exchanger comprising a frame plate 1, a pressure plate 2 and a package of elongated and substantially rectangular heat exchange plates 3. The pressure plate 2 and the heat exchange plates 3 are supported by a horizontal beam 4, which in turn is supported by the frame plate 1 and a column 5. Between the frame plate 1 and the column 5 there is also extending a horizontal guiding rod 6 arranged to keep the heat exchange plates and the pressure plate 2 in desired positions, so that the long sides of the heat exchange plates extend vertically.

Necessary means for compressing the heat exchange plates 3 between the frame plate 1 and the pressure plate 2 is not shown in the drawing.

The frame plate 1 has an inlet member 7 which through a conduit 8 is connected to a source 9 of liquid to be evaporated in the plate heat exchanger. Further, the frame plate 1 has an inlet member 10 and an outlet member 11 for a heating medium. The inlet member 10 is through a conduit 12 connected to a source 13 of heating medium, and the outlet member 11 is connected through a conduit 14 to a reception place 15 for the medium after it has been utilized in the plate heat exchanger.

As can be seen from FIG. 1, each of the heat exchange plates 3 is lacking one of its corner portions. In their other corner portions the heat exchange plates have aligned ports, which thus form channels through the whole package of heat exchange plates. One of these channels communicates with the inlet member 7 and with every second plate interspace in the plate package, whereas the two other channels communicate with the other plate interspaces and with the inlet member 10 and the outlet member 11, respectively.

By means of arrows 16 it is illustrated in FIG. 1 that the plate interspaces, which through one of said channels communicate with the inlet member 7, are open towards the surrounding atmosphere at the inclined plate edges, where the plates are without corner portions.

In practice the whole heat exchanger is surrounded by a casing, which has an outlet for liquid at its lower part and an outlet for steam at its upper part. This casing is not shown in the drawing, however.

Figure 2:
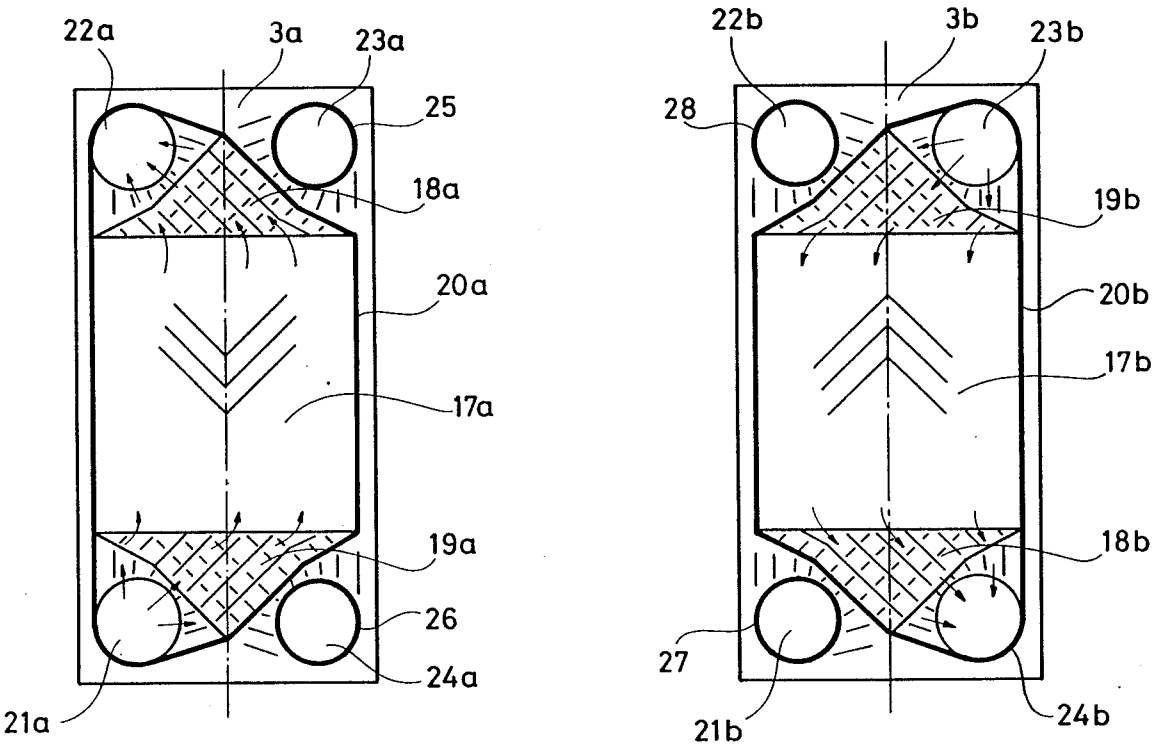
FIG. 2 shows two conventional heat exchange plates.

FIG. 2 shows two identical conventional heat exchange plates **3*a* and 3*b*, respectively. One of the plates is turned 180° in its own plane relative to the other. Each of the plates has a primary heat exchange portion 17*a* and 17*b*, respectively, and on each side thereof a secondary heat exchange portion 18*a* and 18*b*, respectively, and 19*a* and 19*b*, respectively. An endless gasket 20*a* and 20*b*, respectively, extends around all of the heat exchange portions and is arranged in a gasket groove in the plate. In its corner portions the plate 3*a* has ports 21*a*, 22*a*, 23*a* and 24*a*, and the plate 3*b* has corresponding ports 21*b*, 22*b*, 23*b* and 24*b*. As can be seen, the ports 21*a* and 22*a* of the plate 3*a* are situated inside the endless gasket 20*a*, whereas the ports 23*b* and 24*b* of the plate 3*b* are situated inside the endless gasket 20*b***.

Around the ports **23*a* and 24*a* of the plate 3*a* there are annular gaskets 25 and 26, respectively, arranged in gasket grooves, and annular gaskets 27 and 28 are arranged in gasket grooves around the ports 21*b* and 22*b*, respectively, of the plate 3*b***.

When a plate **3*a* is superimposed on a plate 3*b* there is formed a plate interspace with a passage being delimited by the gasket 20*b* and extending between the ports 23*a*, 23*b* and the ports 24*a*, 24*b*. Further, there are formed by the annular gaskets 27 and 28 short closed channels bridging the plate interspace between the ports 21*a* and 21*b* and between the ports 22*a* and 22*b*, rspectively. When a plate 3*b* is superimposed on a plate 3*a*, there is formed a plate interspace with a passage being delimited by the gasket 20*a* and extending between the ports 21*a*, 21*b* and the ports 22*a*, 22*b*. Further, there are formed by the annular gaskets 25 and 26 short closed channels bridging the plate interspace between the ports 23*a* and 23*b*, respectively, and between the ports 24*a* and 24*b***, respectively.

In a package of plates, in which every second plate is of the kind **3*a* and the other plates of the kind 3*b* there are thus formed four different channels through the plate package, every second plate interspace communicating with the two channels formed by the ports 21*a*, 21*b* and the ports 22*a*, 22*b*, respectively, whereas the other plate interspaces communicate with the two channels formed by the ports 23*a*, 23*b* and the ports 24*a*, 24*b***, respectively.

Figure 3:
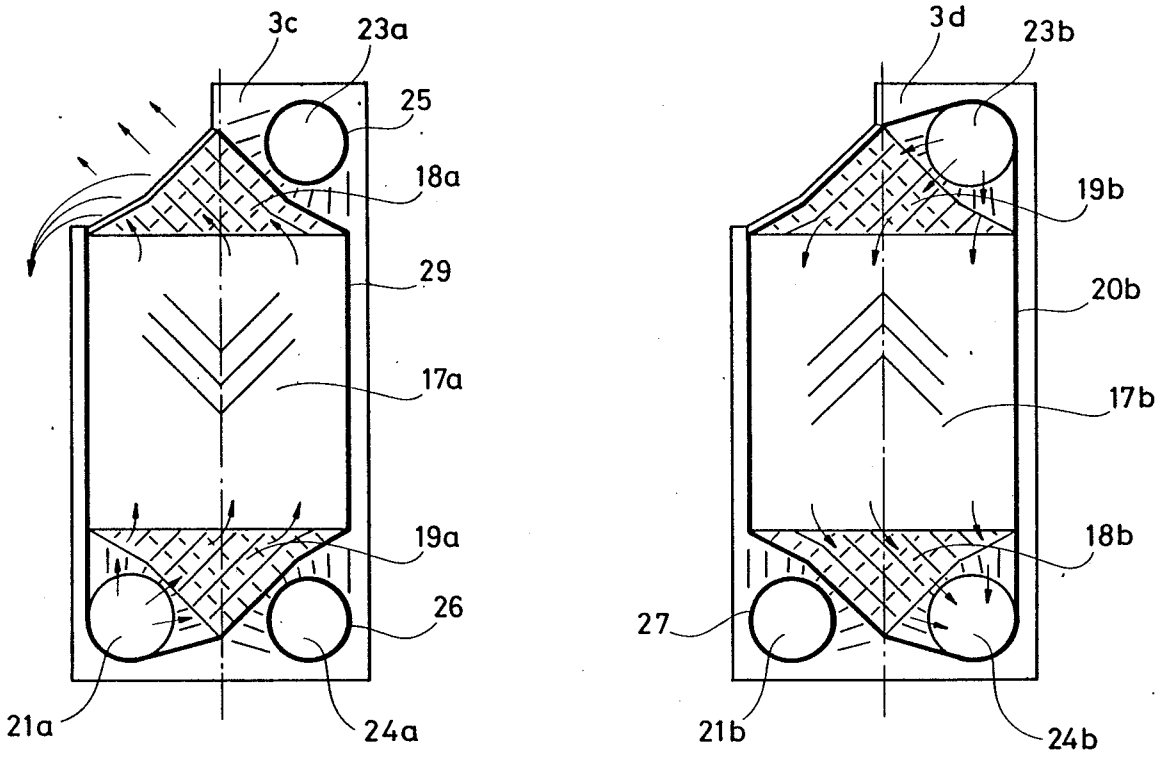
FIG. 3 shows two heat exchange plates formed for a plate heat exchanger according to the invention.

FIG. 3 shows two plates **3*c* and 3*d*, from each of which a corner portion has been removed. For the rest the plates 3*c* and 3*d* are formed in exactly the same way as the plates 3*a* and 3*b*, respectively, in FIG. 2. For the sake of simplicity the same reference numberals have been used in FIG. 3 as in FIG. 2**.

The plate **3*d* is equipped with exactly the same kind of gaskets 20*b* and 27 as the plate 3*b*. The plate 3*c* is equipped with the same kind of annular gaskets 25 and 26 as the plate 3*a* but has a gasket 29 which differs from the gasket 20*a* of the plate 3*a***. As can be seen from FIG.

3, the gasket 29 has a portion missing at the left part of the secondary heat exchange portion 18*a* of the plate 3*c*.

The plate heat exchanger shown in FIG. 1 comprises a package of heat exchange plates, in which every second plate is of the kind 3*c* and the other plates are of the kind 3*d* according to FIG. 3. The inlet member 7 for liquid to be evaporated in the heat exchanger communicates with the channel through the plate package, which is formed by the ports 21*a* and 21*b* of the plates 3*c* and 3*d*, respectively, and which in turn communicates with every second plate interspace in the plate package. These plate interspaces open at 16 (FIG. 1) into the surrounding atmosphere. The inlet member 10 and the outlet member 11 for a heating medium communicate with the channels through the plate package, which are formed by the ports 23*a*, 23*b* and 24*a*, 24*b*, respectively, and which in turn both communicate with the other plate interspaces in the plate package.

Figure 4:
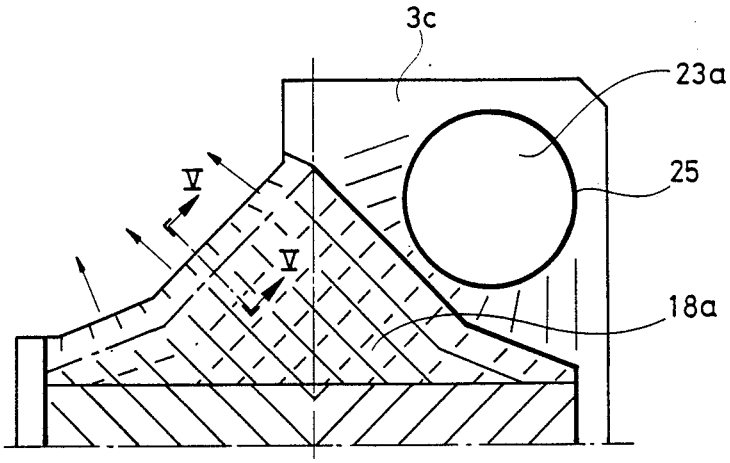
FIG. 4 shows a part of a heat exchange plate according to FIG. 3.

FIG. 4 shows the upper part of the plate 3*c* according to FIG. 3.

Figure 5:
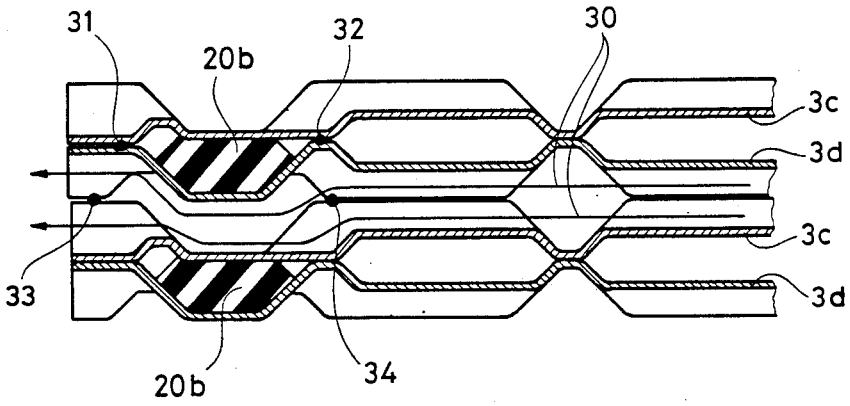
FIG. 5 shows a section through a part of a plate package, taken along a line V—V in FIG. 4.

FIG. 5 shows a cross-section through a part of a plate package taken along a line V—V in FIG. 4. The shown part of the plate package comprises two plates 3*c* and two plates 3*d*. Between the upper one of the two plates 3*d* and the lower one of the plates 3*c* there is formed a plate interspace intended for the liquid to be evaporated in the plate heat exchanger. Flow lines 30 are shown in this plate interspace for steam that has been formed therein and for possibly remaining liquid.

As can be seen from FIG. 5, the heat exchange plates 3*c* and 3*d* have protuberances and depressions causing adjacent plates to abut against each other at different places. For instance, the plates are supporting each other at places 31 and 32 in one of the plate interspaces and at places 33 and 34 in an adjacent plate interspace. All of these places are situated close to the gasket grooves of the different plates. Since a gasket is missing in the gasket grooves of the plates 3*c*, the plates in an arrangement like this have to abut against each other at said places 33 and 34. If a support were missing at one of these places, it would not be possible to keep the plates compressed firmly enough in the area of the gaskets 20*b*, and a leakage then could come up past these gaskets.

The need of support between the plates outside the gaskets 20*b* brings with it a certain disadvantage, as an undesired reduction of the through-flow cross-section and changes of the flow direction for out-flowing steam will thereby arise. This drawback is avoided in an arrangement according to FIG. 6 and FIG. 7.

Figure 6:
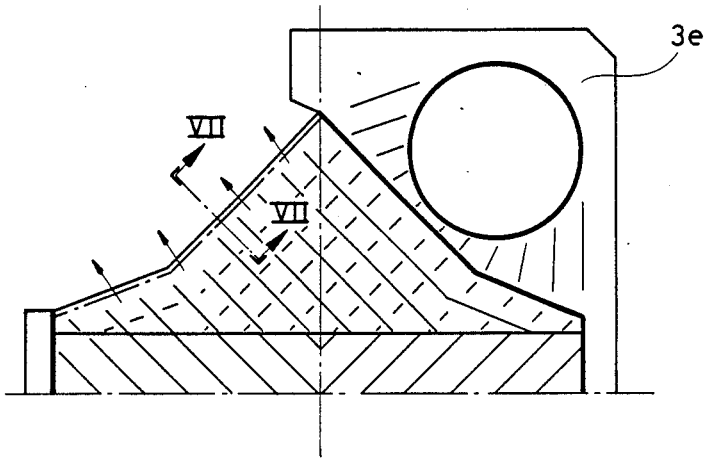
FIG. 6 shows a part of a heat exchange plate according to a modification of the invention.

FIG. 6 shows the upper part of a plate 3*e* which, except for in one respect to be explained later, is identical with the plate 3*c* in FIG. 4.

Figure 7:
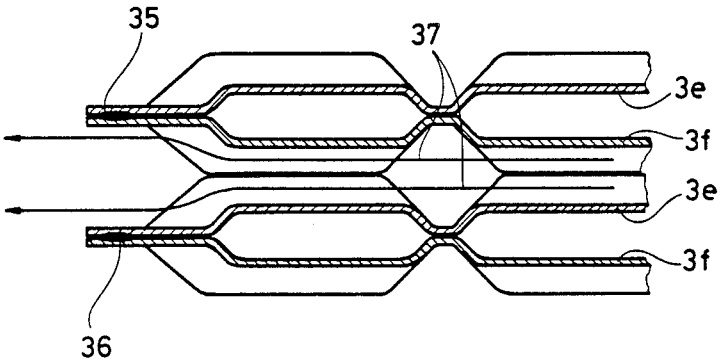
FIG. 7 shows a section through part of a plate package, taken along a line VII—VII in FIG. 6.

FIG. 7 shows a cross-section through a part of a plate package, taken along a line VII—VII in FIG. 6. The shown part of the plate package comprises two plates 3*e* and two plates 3*f*. Each plate 3*f* is pressed like a plate 3*e*, but it has been turned in relation thereto 180° around a line extending in the plane of the plate itself, before one of its corner portions has been removed. Therefore, if the plate 3*e* were a plate pressed like the plate 3*a* in FIG. 2 (without gaskets), the plate 3*f* would be a similarly pressed plate turned 180° around a horizontal line extending in the plane of the plate.

A plate 3*e* differs from a plate 3*c* only in that a somewhat larger corner portion has been removed. As can be seen upon comparison between FIG. 5 and FIG. 7, the plate 3*e* has been cut along the bottom of the gasket groove itself, whereas the plate 3*c* has been cut along a line at some distance outside the gasket groove.

Since one of two adjacent plates 3*e* and 3*f* is turned relative to the other 180° C. around a line extending in the plane of the plate, the plates will abut against each other along the bottoms of their gasket grooves. These groove bottoms thereby can be connected sealingly with each other by soldering, glueing, welding, or the like, as shown at 35 and 36 in FIG. 7. In this way plate units, each consisting of two permanently interconnected plates, may be produced and be assembled to a plate package.

Each plate unit forms a plate interspace that is delimited by said sealing connection between the gasket groove bottoms of the plates, these gasket groove bottoms being situated, however, in other planes spaced from each other along short distances at two of the corner portions of the plate, so that the plate interspace in these areas communicates with two port channels through the plate package for one of the heat exchanging media. The interspaces formed between the plate units are preferably used for the liquid to be evaporated, and in each of these interspaces a gasket similar to the gasket 29 in FIG. 3 can be used. A part of such an interspace between two plate units is shown in FIG. 7, in which there are shown two flow lines 37 for formed steam and possibly remaining liquid, when these media are leaving the interspace. As can be seen upon comparison between FIG. 5 and FIG. 7, the area of the outlet for the formed steam and possibly remaining liquid is substantially larger in the area of the gasket grooves at the arrangement in FIG. 7 than at the arrangement in FIG. 5. Furthermore, at the arrangement in FIG. 7 the heat exchange plates have no flow restricting parts outside the area of the gasket grooves.

In all of the heat exchange plates shown in the drawing the secondary heat exchange portions are provided with a press pattern in accordance withe the patent U.S. Pat. No. 3,783,090.

In the above described embodiments of the invention all of the heat exchange plates are provided with the same kind of press pattern. This is of course not necessary. Different kinds of heat exchange plates may very well be used. It is also sufficient if every second one of the heat exchange plates in a package is without a corner portion as has been describe above. In an arrangement of this kind, namely, the rest of the plates in the area of the removed corner portions will be situated at a distance from each other and, therefore, will not create any substantial flow resistance for out-flowing steam and possibly remaining liquid.

Further, there is shown in all of the described embodiments a medium flow in each plate interspace between two ports of a heat exchange plate, situated at one and the same long side thereof. The invention can be used also in connection with so called diagonal flow, i.e. when the inlet of each plate interspace is situated at one long side of the respective plates and the outlet is situated at the other long side of the respective plates.

Furthermore, the invention can be used in connection with heat exchange plates, which apart from ports in their corner portions have further ports at other places. For instance, according to the invention, an elongated heat exchange plate that is arranged vertically may be without an upper corner portion, may have a port in its remaining upper corner portion, intended to be connected to an inlet for a heating medium, may have two ports in its lower corner portions, which two ports are intended to be connected to a reception place for already used heating medium, and may have one or more further ports situated between the last mentioned two ports and intended to be connected to an inlet for liquid to be evaporated in the plate heat exchanger.

What is claimed:

1. Plate heat exchanger comprising a package of heat exchange plates, each of which is elongated and substantially rectangular and has a central heat exchange portion and corner portions provided with ports, an inlet member (7) connected both to a source (9) of liquid to be at least partly evaporated in the plate heat exchanger and to a first channel extending through the package of heat exchange plates, which channel is formed by aligned ports in the heat exchange plates, inlet and outlet members (5, 11) connected both to a source (13) and a reception place (15), respectively, for a heating medium and to two other channels extending through the package of heat exchange plates, which channels are formed by aligned ports in the heat exchange plates on both sides of the central heat exchange portions of the heat exchange plates, said first channel communicating with only every second interspace between the heat exchange plates, whereas the other two channels communicate with the other interspaces between the heat exchange plates, and sealing means arranged between adjacent heat exchange plates in a way such that said liquid and heating medium during operation of the heat exchanger are allowed to flow substantially in parallel through the plate interspaces in the longitudinal direction of the heat exchange plates either concurrently or countercurrently, characterized in that at least every second one of the heat exchange plates (3c–3f) is without a corner portion, in which a port of the same kind as anyone of the other ports could have been situated, and said sealing means leaves outlet openings (16) from the plate interspaces, which communicate with said first channel, in those areas of the heat exchange plates (3c–3f) where at least every second one thereof is without a corner portion.

2. Plate heat exchanger according to claim 1, characterized in that each of the heat exchange plates (3c–3f) is without a corner portion.

3. Plate heat exchanger according to claim 1, characterized in that each of the plates being without a corner portion has a port in each of its other three corner portions, the plate ports forming three channels through the plate package, one of which is connected to said inlet member (7) for liquid to be evaporated and the other two channels—formed by ports situated on both sides of the central heat exchange portion of the plates—are connected to said inlet member (10 ) and outlet member (11), respectively, for the heating medium.

4. Plate heat exchanger according to claim 3, characterized in that the central heat exchange portion of each heat exchange plate comprises a rectangular portion (17a, 17b) and two triangular portions (18a, 18b; 19a, 19b)—one on each side of the rectangular portion—each of said triangular portions having a base side turned towards the rectangular portion (17a, 17b) and two further sides turned away therefrom, and that each of said outlet openings (16) extends in parallel with one of said further sides of one of the triangular portions.

5. Plate heat exchanger according to claim 1 characterized in that the heat exchange plates (3c–3f) are arranged with their long sides substantially vertically, said outlet openings (16) being directed upwardly.

6. Plate heat exchanger according to claim 1 characterized in that the heat exchange plates (3e, 3f) have pressed gasket grooves around their central heat exchange portions, every second heat exchange plate is turned relative to the other heat exchange plates such that the rear sides of the gasket groove bottoms of two adjacent heat exchange plates are abutting against each other, the adjacent heat exchange plates are sealingly connected with each other along said abutting rear sides of the groove bottoms, the plate interspaces which are formed by adjacent plates turning their gasket grooves towards each other are connected to said first channel for receiving liquid to be evaporated, and the heat exchange plates along said outlet openings (16) are cut in the bottoms of the gasket grooves outside a line (35, 36), along which the heat exchange plates (3e, 3f) are sealingly connected with each other.

* * * * *